US010774274B2

(12) United States Patent
Wong et al.

(10) Patent No.: US 10,774,274 B2
(45) Date of Patent: Sep. 15, 2020

(54) PROCESS AND APPARATUS FOR A SETTLER AND FIRST STAGE WATER WASH IN A CAUSTIC FREE KEROSENE SWEETENING REACTOR

(71) Applicant: UOP LLC, Des Plaines, IL (US)

(72) Inventors: Susanna Kiki Wong, Chicago, IL (US); Jonathan A. Tertel, Mount Prospect, IL (US)

(73) Assignee: UOP LLC, Des Plaines, IL (US)

( * ) Notice: Subject to any disclaimer, the term of this patent is extended or adjusted under 35 U.S.C. 154(b) by 228 days.

(21) Appl. No.: 15/964,482

(22) Filed: Apr. 27, 2018

(65) Prior Publication Data

US 2019/0330545 A1 Oct. 31, 2019

(51) Int. Cl.
*C10G 53/12* (2006.01)

(52) U.S. Cl.
CPC ..... *C10G 53/12* (2013.01); *C10G 2300/1051* (2013.01); *C10G 2300/202* (2013.01); *C10G 2400/08* (2013.01)

(58) Field of Classification Search
CPC ..... C10G 53/12; C10G 2300/1051; C10G 2300/202; C10G 2400/08
See application file for complete search history.

(56) References Cited

U.S. PATENT DOCUMENTS

| | | | |
|---|---|---|---|
| 4,019,869 | A | 4/1977 | Morris |
| 4,049,572 | A | 9/1977 | Douglas |
| 4,746,494 | A | 5/1988 | Maple et al. |
| 7,223,332 | B1 | 5/2007 | Tertel et al. |

FOREIGN PATENT DOCUMENTS

| | | | |
|---|---|---|---|
| EP | 145439 | B1 | 3/1988 |

*Primary Examiner* — Timothy C Cleveland

(57) ABSTRACT

The present invention relates to a combined reactor settler with the reactor. More specifically, the present invention relates to a combined reactor settler and reactor in a caustic free kerosene sweetening reactor which reduces equipment costs, operating costs, and plot space requirements.

15 Claims, 1 Drawing Sheet

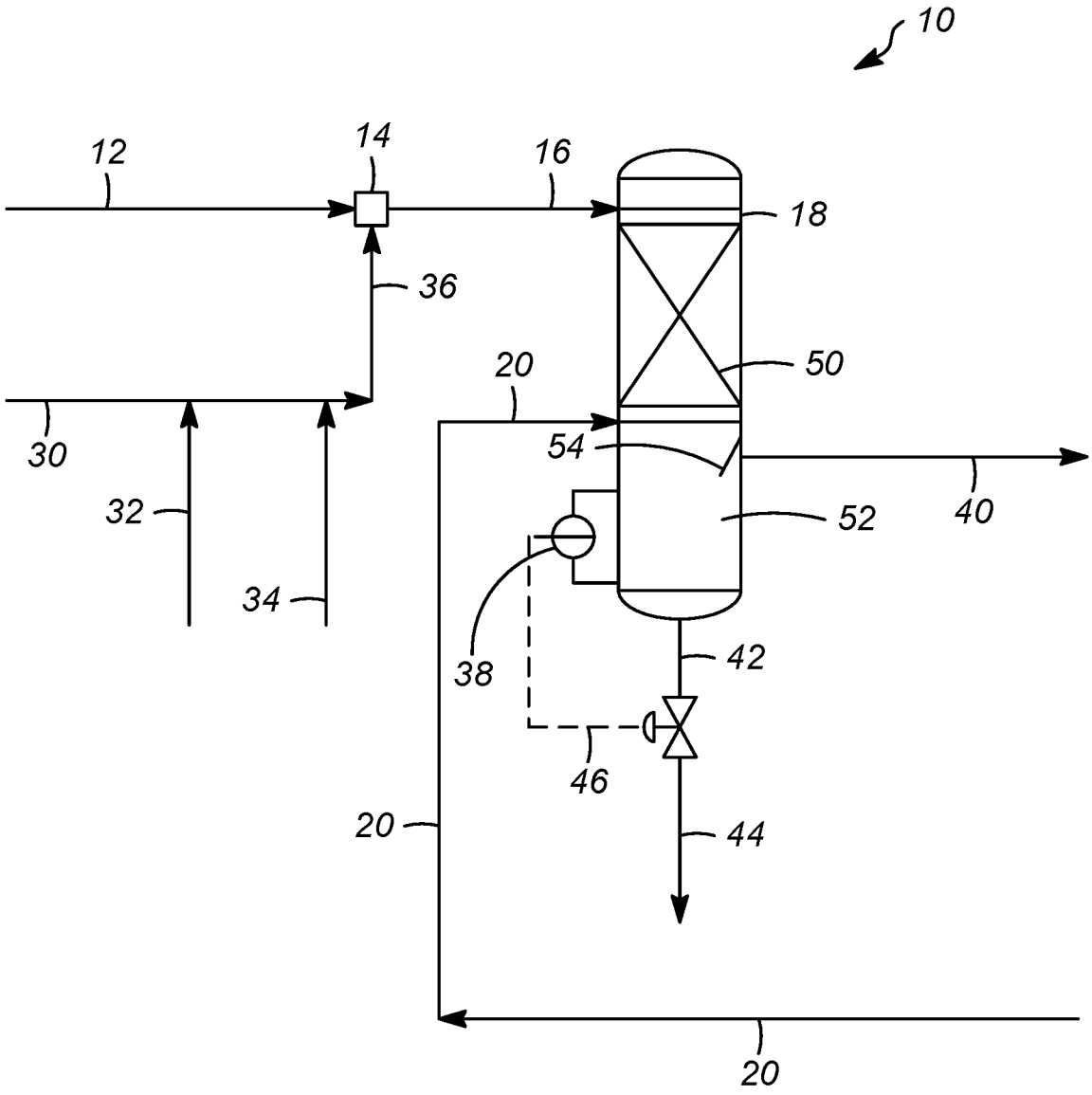
10
12
14
16
18
36
20
50
30
54
40
32
52
34
38
42
46
20
44
20

PROCESS AND APPARATUS FOR A SETTLER AND FIRST STAGE WATER WASH IN A CAUSTIC FREE KEROSENE SWEETENING REACTOR

FIELD

The present invention relates to a combined reactor settler with the reactor. More specifically, the present invention relates to a combined reactor settler, first stage water wash, and reactor in a single vessel, the caustic free kerosene sweetening reactor, which reduces equipment costs, operating costs, and plot space requirements.

BACKGROUND

The invention relates to a hydrocarbon treating process referred to as sweetening. In this process, mercaptans present in a liquid hydrocarbon stream such as naphtha or kerosene are oxidized in the presence of an aqueous alkaline solution to disulfide compounds which remain in the hydrocarbon stream. The aqueous alkaline solution may aqueous or anhydrous ammonia. The sweetening of sour petroleum fractions is a well developed commercial process which is employed in almost all petroleum refineries. Sweetening processes, therefore, do not remove sulfur from the hydrocarbon feed stream but convert it to an acceptable form. The sweetening process involves the admixture of an oxygen supply stream, typically air, to the hydrocarbon stream to supply the required oxygen. The admixture of hydrocarbon and air contact an oxidation catalyst in an aqueous alkaline environment. The oxidation catalyst may be impregnated on a solid composite or may be dispersed or dissolved in the aqueous alkaline solution. Currently there are two stages of water wash and a reactor settler (horizontal vessel) in caustic-free kerosene/jet fuel (Kero/JF) sweetening process to minimize the amount of soluble alkali content in the treated hydrocarbon. Customers have limited plot space for new and revamp projects, so it is often requested to eliminate equipment.

SUMMARY

The invention relates to a hydrocarbon treating process referred to as sweetening. In this process, mercaptans present in a liquid hydrocarbon stream such as naphtha or kerosene are oxidized in the presence of an aqueous alkaline solution to disulfide compounds which remain in the hydrocarbon stream. The sweetening of sour petroleum fractions is a well developed commercial process which is employed in almost all petroleum refineries. Sweetening processes, therefore, do not remove sulfur from the hydrocarbon feed stream but convert it to an acceptable form. The sweetening process involves the admixture of an oxygen supply stream, typically air, to the hydrocarbon stream to supply the required oxygen. The admixture of hydrocarbon and air contact an oxidation catalyst in an aqueous alkaline environment. The oxidation catalyst may be impregnated on a solid composite or may be dispersed or dissolved in the aqueous alkaline solution. A commonly employed oxidation catalyst comprises a metal phthalocyanine compound impregnated on activated charcoal. A suitable catalyst is described in U.S. Pat. No. 4,049,572. The present disclosure describes a combined reactor settler and first stage water wash with the reactor. Hence, eliminating the separate first stage water wash vessel and static mixer, reducing costs and plot space requirement.

In the foregoing, all temperatures are set forth in degrees Celsius and, all parts and percentages are by weight, unless otherwise indicated. Other objects, advantages and applications of the present invention will become apparent to those skilled in the art from the following detailed description and drawing. Additional objects, advantages and novel features of the examples will be set forth in part in the description which follows, and in part will become apparent to those skilled in the art upon examination of the following description and the accompanying drawing or may be learned by production or operation of the examples. The objects and advantages of the concepts may be realized and attained by means of the methodologies, instrumentalities and combinations particularly pointed out in the appended claims.

Definitions

As used herein, the term "stream", "feed", "product", "part" or "portion" can include various hydrocarbon molecules, such as straight-chain, branched, or cyclic alkanes, alkenes, alkadienes, and alkynes, and optionally other substances, such as gases, e.g., hydrogen, or impurities, such as heavy metals, and sulfur and nitrogen compounds. Each of the above may also include aromatic and non-aromatic hydrocarbons.

Hydrocarbon molecules may be abbreviated C1, C2, C3, Cn where "n" represents the number of carbon atoms in the one or more hydrocarbon molecules or the abbreviation may be used as an adjective for, e.g., non-aromatics or compounds. Similarly, aromatic compounds may be abbreviated A6, A7, A8, An where "n" represents the number of carbon atoms in the one or more aromatic molecules. Furthermore, a superscript "+" or "−" may be used with an abbreviated one or more hydrocarbons notation, e.g., C3+ or C3−, which is inclusive of the abbreviated one or more hydrocarbons. As an example, the abbreviation "C3+" means one or more hydrocarbon molecules of three or more carbon atoms.

As used herein, the term "zone" can refer to an area including one or more equipment items and/or one or more sub-zones. Equipment items can include, but are not limited to, one or more reactors or reactor vessels, separation vessels, distillation towers, heaters, exchangers, pipes, pumps, compressors, and controllers. Additionally, an equipment item, such as a reactor, dryer, or vessel, can further include one or more zones or sub-zones.

BRIEF DESCRIPTION OF THE DRAWING

The FIGURE illustrates an example of a combined reactor settler, first stage water wash, and reactor in a caustic-free kerosene/jet fuel sweetening reactor which reduces equipment costs, operating costs, and plot space requirements.

DETAILED DESCRIPTION

The following detailed description is merely exemplary in nature and is not intended to limit the application and uses of the embodiment described. Furthermore, there is no intention to be bound by any theory presented in the preceding background or the following detailed description.

The description of the apparatus of this invention is presented with reference to the attached FIGURE. The FIGURE is a simplified diagram of the preferred embodiment of this invention and is not intended as an undue limitation on the generally broad scope of the description provided herein and the appended claims. Certain hardware such as valves, pumps, compressors, heat exchangers, instrumentation and controls, have been omitted as not essential to a clear understanding of the invention. The use and application of this hardware is well within the skill of the art.

In the example shown in the FIGURE, this invention will combine the reactor settler with the first stage water wash with the reactor. This is done by adding the ability to add water below the reactor section as well as settling volume at the bottom of the reactor. The static mixer upstream of the conventional first stage water wash will be eliminated. Water should be routed to the middle section (below the catalyst bed) of the reactor via an inlet distributor to serve as the first stage water wash. The reactor will be on level control where spent water can be routed to either the sour water stripper or other destinations in the plant.

The various embodiments described herein relate to a vessel containing a reaction section and a setting/water washing section. As shown in the FIGURE, an apparatus 10 comprises of a mercaptan oxidation reactor vessel 18 includes two sections. A reaction section 50 may be separated from a separation and water wash section 52 by a shield. The shield may extend across the entire lateral cross-section of the reactor vessel 18 in an embodiment. A top end of the reactor vessel 18 partially defines the reaction section 50 and a bottom end partially defines the separation and water wash section 52. A bed of catalyst is supported on the shield. The shield is permeable to fluid flow but substantially prevents the catalyst from falling into the separation and water wash section 52. However, catalyst fines that have dimensions smaller than openings in the shield may travel from the reaction section 50 to the separation and water wash section 52.

In an embodiment, the reaction section 50 is above the separation and water wash section 52 to provide for downflow of feed through the reactor vessel 18. In a further embodiment, a distributor in the reactor vessel 18 has nozzles directed away from the catalyst bed. In an embodiment, the shield may be configured such that all of the fluid in the reaction section 50 must flow through the shield to enter the separation and water wash section 52. A combined feed stream 16 is introduced into the reactor vessel 18 above the reaction section 50. Hydrocarbon stream 30 is combined with alkaline stream 32 and catalyst promoter stream 34 forming stream 36. Stream 36 is mixed with air stream 12 in air mixer 14 to form the combined feed stream 16. In the reaction section 50, mercaptans in the hydrocarbon stream 30 are oxidized to disulfides in a sweetening process. In the separation and water wash section 52, the sweetened hydrocarbon stream including the disulfides separate from the aqueous alkaline solution which has a heavier specific gravity. The soluble alkali content in the sweetened hydrocarbon is partially washed off by the water stream 20 entering below the reactor reaction 50 before the hydrocarbon 40 is routed to the second stage water wash. The main reason for needing multiple stages of water wash (which are not needed for the caustic kerosene mercaptan oxidation) is the increased solubility of ammonia in the hydrocarbon. Combining the first stage of water wash with the settling section allows reduction of a vessel.

An interface develops in the separation and water wash section 52 between the hydrocarbon phase and the aqueous alkaline phase. A hydrocarbon outlet stream 40 permits withdrawal of the sweetened hydrocarbon phase through a line or conduit. A baffle 54 comprising an upper portion defining a partial cone and a lower hook lip shields the hydrocarbon outlet stream 40 from descending alkali solution. Consequently, only hydrocarbon which ascends with respect to the aqueous alkali along with perhaps an equilibrium amount of alkaline solution will enter into the hydrocarbon outlet stream 40. An alkaline outlet stream 42 allows aqueous alkaline solution to be withdrawn through a line. A level indicator controller 38 governs a control valve on the line 42 by a level control signal 46 to regulate the flow rate through the alkaline outlet 42. The flow rate is controlled to maintain the interface between the hydrocarbon and alkaline phases below the hydrocarbon outlet 40. The alkaline solution removed through the line 42 can either be taken to further treatment and disposal through a line 44.

The hydrocarbon outlet 40 is directly communicated to an inlet to the residual alkali removal unit by the conduit. If the sweetened kerosene will not be used for jet fuel, the sweetened kerosene in the conduit may be directly delivered to a residual alkali removal unit such as a sand filter (not shown) to coalesce and drop out remaining aqueous alkaline solution from the sweetened kerosene.

Any of the above lines, conduits, units, devices, vessels, surrounding environments, zones or similar may be equipped with one or more monitoring components including sensors, measurement devices, data capture devices or data transmission devices. Signals, process or status measurements, and data from monitoring components may be used to monitor conditions in, around, and on process equipment. Signals, measurements, and/or data generated or recorded by monitoring components may be collected, processed, and/or transmitted through one or more networks or connections that may be private or public, general or specific, direct or indirect, wired or wireless, encrypted or not encrypted, and/or combination(s) thereof; the specification is not intended to be limiting in this respect.

Signals, measurements, and/or data generated or recorded by monitoring components may be transmitted to one or more computing devices or systems. Computing devices or systems may include at least one processor and memory storing computer-readable instructions that, when executed by the at least one processor, cause the one or more computing devices to perform a process that may include one or more steps. For example, the one or more computing devices may be configured to receive, from one or more monitoring component, data related to at least one piece of equipment associated with the process. The one or more computing devices or systems may be configured to analyze the data. Based on analyzing the data, the one or more computing devices or systems may be configured to determine one or more recommended adjustments to one or more parameters of one or more processes described herein. The one or more computing devices or systems may be configured to transmit encrypted or unencrypted data that includes the one or more recommended adjustments to the one or more parameters of the one or more processes described herein.

While the invention has been described with what are presently considered the preferred embodiments, it is to be understood that the invention is not limited to the disclosed embodiments, but it is intended to cover various modifications and equivalent arrangements included within the scope of the appended claims.

SPECIFIC EMBODIMENTS

While the following is described in conjunction with specific embodiments, it will be understood that this description is intended to illustrate and not limit the scope of the preceding description and the appended claims.

A first embodiment of the invention is an apparatus, comprising a reactor comprising a reaction section having a water wash and a separation section; a first inlet stream comprising air, kerosene and jet fuel, an alkaline stream (dilute ammonia), and a catalyst activator; a second inlet stream comprising water for the water wash; a first outlet stream comprising a sweetened hydrocarbon; and a second outlet stream comprising a spent water stream. An embodiment of the invention is one, any or all of prior embodiments in this paragraph up through the first embodiment in this paragraph, wherein the first inlet stream enters the vessel above the reaction section. An embodiment of the invention is one, any or all of prior embodiments in this paragraph up through the first embodiment in this paragraph, wherein the second inlet stream enters the vessel below the separation section. An embodiment of the invention is one, any or all of prior embodiments in this paragraph up through the first embodiment in this paragraph, wherein the alkaline stream comprises dilute ammonia. An embodiment of the invention is one, any or all of prior embodiments in this paragraph up through the first embodiment in this paragraph, wherein the vessel operates at a temperature of about 32° C. to about 50° C. An embodiment of the invention is one, any or all of prior embodiments in this paragraph up through the first embodiment in this paragraph, wherein the separation section operates at a pressure of about 340 kPa to about 2100 kPa. An embodiment of the invention is one, any or all of prior embodiments in this paragraph up through the first embodiment in this paragraph, further comprising sending the first outlet stream to a second stage water wash column. An embodiment of the invention is one, any or all of prior embodiments in this paragraph up through the first embodiment in this paragraph, further comprising sending the second outlet stream to a sour water stripper. An embodiment of the invention is one, any or all of prior embodiments in this paragraph up through the first embodiment in this paragraph, wherein there is a control on the separation section that controls hydrocarbon aqueous interface by withdrawing spent water to the sour water stripper. An embodiment of the invention is one, any or all of prior embodiments in this paragraph up through the first embodiment in this paragraph, wherein the second inlet stream comprising water comes from a water wash from a second stage water wash section. An embodiment of the invention is one, any or all of prior embodiments in this paragraph up through the first embodiment in this paragraph, wherein the first inlet stream comprises air, kerosene and jet fuel from a pretreatment section, an ammonia injection, and a caustic free catalyst activator. An embodiment of the invention is one, any or all of prior embodiments in this paragraph up through the first embodiment in this paragraph, further comprising a baffle above the first outlet stream. An embodiment of the invention is one, any or all of prior embodiments in this paragraph up through the first embodiment in this paragraph, further comprising an air mixer upstream from the vessel. An embodiment of the invention is one, any or all of prior embodiments in this paragraph up through the first embodiment in this paragraph, wherein all of the fluid passing from the reaction section to the separation section passes through a fluid permeable shield. An embodiment of the invention is one, any or all of prior embodiments in this paragraph up through the first embodiment in this paragraph, wherein the fluid permeable shield is positioned between the inlet and the second end of the vessel. An embodiment of the invention is one, any or all of prior embodiments in this paragraph up through the first embodiment in this paragraph, further including a baffle between the inlet and the hydrocarbon outlet. An embodiment of the invention is one, any or all of prior embodiments in this paragraph up through the first embodiment in this paragraph, further comprising at least one of sensing at least one parameter of the process and generating a signal or data from the sensing; generating and transmitting a signal; or generating and transmitting data.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

The invention claimed is:

1. An apparatus, comprising:

a reactor vessel comprising a reaction section, a water wash and flail separation section, and a fluid permeable shield positioned between the reaction section and the water wash and separation section, wherein fluid passes from the reaction section to the water wash and separation section through said fluid permeable shield;

a catalyst bed supported on the fluid permeable shield;

a hydrocarbon inlet to the vessel located above the reaction section;

a water inlet to the vessel located in the water wash and separation section;

an alkaline outlet from the vessel located at the bottom of the vessel; and a sweetened hydrocarbon outlet from the vessel located below said water inlet and above said alkaline outlet.

2. The apparatus of claim 1, wherein an alkaline stream comprising dilute ammonia enters through the hydrocarbon inlet.

3. The apparatus of claim 1, wherein the vessel operates at a temperature of about 32° C. to about 50° C.

4. The apparatus of claim 1, wherein the water wash and separation section operates at a pressure of about 340 kPa to about 2100 kPa.

5. The apparatus of claim 1, further comprising a second stage water wash column in fluid communication with the sweetened hydrocarbon outlet.

6. The apparatus of claim 1, further comprising a sour water stripper in fluid communication with the alkaline outlet.

7. The apparatus of claim 1, further comprising a level indicator controller in communication with the water wash and separation section and the alkaline outlet that controls a hydrocarbon aqueous interface by withdrawing spent water to a sour water stripper.

8. The apparatus of claim 1, wherein the water inlet is in fluid communication with a water outlet of a second stage water wash section.

9. The apparatus of claim 1, further comprising a baffle above the sweetened hydrocarbon outlet.

10. The apparatus of claim 1, further comprising an air mixer upstream from the vessel.

11. The apparatus of claim 1, wherein all of said fluid passing from the reaction section to the water wash and separation section passes through the fluid permeable shield.

12. The apparatus of claim 1, further including a baffle positioned at a level between said water inlet and said sweetened hydrocarbon outlet.

13. The apparatus of claim 7 further comprising a control valve in communication with the level indicator controller.

14. The apparatus of claim 1 further comprising a distributor having nozzles directed away from the catalyst bed.

15. The apparatus of claim 1 further comprising a residual alkali removal unit in fluid communication with said sweetened hydrocarbon outlet.

* * * * *